US009576724B2

(12) United States Patent
Best et al.

(10) Patent No.: US 9,576,724 B2
(45) Date of Patent: Feb. 21, 2017

(54) INTEGRATED SOUND SHIELD FOR AIR CORE REACTOR

(71) Applicant: Trench Limited, Scarborough, Ontario (CA)

(72) Inventors: Fabian Best, Ajax (CA); Tom Chiu Hung Lau, Toronto (CA)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 14/892,735

(22) PCT Filed: May 20, 2014

(86) PCT No.: PCT/CA2014/050463
§ 371 (c)(1),
(2) Date: Nov. 20, 2015

(87) PCT Pub. No.: WO2014/186888
PCT Pub. Date: Nov. 27, 2014

(65) Prior Publication Data

US 2016/0104568 A1 Apr. 14, 2016

Related U.S. Application Data

(60) Provisional application No. 61/825,778, filed on May 21, 2013.

(51) Int. Cl.
*H01F 27/08* (2006.01)
*H01F 27/33* (2006.01)
(Continued)

(52) U.S. Cl.
CPC ..... *H01F 27/33* (2013.01); *G10K 11/002* (2013.01); *H01F 5/02* (2013.01); *H01F 27/06* (2013.01); *H01F 27/08* (2013.01)

(58) Field of Classification Search
CPC ..... H01F 27/00–27/30
(Continued)

(56) References Cited

U.S. PATENT DOCUMENTS 2,494,343 A * 1/1950 Mannal ..... G10K 11/16 336/100
3,260,974 A * 7/1966 Specht ..... H01F 27/33 174/15.1
(Continued)

FOREIGN PATENT DOCUMENTS

CN 201478084 U 5/2010

OTHER PUBLICATIONS

Trench, "Reactors", pp. 1-16, www.trenchgroup.com.; (16 pages).
(Continued)

*Primary Examiner* — Tuyen Nguyen

(57) ABSTRACT

An air core power reactor (10) having a noise mitigating sound shield (40). In one embodiment the sound shield includes a plurality of sound absorbing panels (42*p*) configured for positioning about an outermost reactor layer (12') so that the panels reduce radiation of acoustic energy when the reactor coil layers carry current. One or more flexible members (48) are attached along the first side of each sound absorbing panel for contact with the outermost reactor layer. Sound barrier material (44) is positioned along the second side of each panel. When the flexible members are attached to a panel and the panel is installed about the outermost first layer of the reactor, the flexible members are positioned against the outermost first layer and the flexible members provide a gap between the first side of the panel and the outermost first layer of the reactor.

20 Claims, 3 Drawing Sheets

(51) Int. Cl.

| | |
|---|---|
| ***H01F 5/02*** | (2006.01) |
| ***G10K 11/00*** | (2006.01) |
| ***H01F 27/06*** | (2006.01) |

(58) Field of Classification Search
USPC ..... 336/55–62, 206–208, 210
See application file for complete search history.

(56) References Cited

U.S. PATENT DOCUMENTS

| | | | | |
|---|---|---|---|---|
| 3,264,590 | A * | 8/1966 | Trench | H01F 37/005 336/147 |
| 3,309,639 | A * | 3/1967 | Goolsby, Jr. | H01F 27/33 336/100 |
| 3,529,692 | A * | 9/1970 | Meier | E04B 1/8218 181/202 |
| 4,724,413 | A | 2/1988 | Kataoka | |
| 5,027,099 | A * | 6/1991 | Burke | H01F 37/005 336/180 |
| 6,381,834 | B1 * | 5/2002 | May | H01F 27/306 29/602.1 |

OTHER PUBLICATIONS

PCT International Search Report mailed Jul. 22, 2014 corresponding to PCT International Application No. PCT/CA2014/050463 filed May 20, 2014. (8 pages).

* cited by examiner

INTEGRATED SOUND SHIELD FOR AIR CORE REACTOR

This application claims benefit of the May 21, 2013 filing date of U.S. provisional patent application No. 61/825,778.

FIELD OF THE INVENTION

The present invention relates to dry type air core reactors of the type used in utility and power applications and, more particularly, to a reactor design which mitigates sound generated by winding layers and other components within the reactors.

BACKGROUND OF THE INVENTION

Air core reactors are inductive devices used in high voltage power transmission, distribution and industrial applications. Configurations and designs include devices which have a number of applications, including filtering out harmonics, shunt devices which compensate for introduction of capacitive reactive power, and devices which limit short circuit currents. Air core reactors, typically placed in outdoor environments, are formed with a series of concentrically positioned, spaced-apart winding layers, referred to as packages, each having a cylindrical configuration. These designs allow for some cooling of the winding layers by movement of air convection currents between the spaced-apart winding layers. The winding layers are positioned between upper and lower current carrying members, sometimes referred to as spider units. The spider units comprise a series of arms radiating along a plane and away from a central position in a star configuration.

Among other functions, the spider units may serve as line terminals for connecting power lines and for connecting the winding layers in an electrically parallel configuration. The reactors are normally installed with the spider units occupying a horizontal orientation with respect to an underlying horizontal ground plane so that the major axis of the cylindrical configuration extends vertically upward from the ground plane. For a single reactor, or for the lower-most reactor in a stacked configuration of two or more reactors, the winding layers are supported above the ground by the lower spider unit and a series of insulators and structural leg members which extend from the lower spider unit to the ground.

Sound radiated from air core reactors can be a serious irritant to population groups living nearby. In the past, these sound levels have been reduced with sound shields, typically in the form of self-supporting fiberglass enclosures, that completely surround one or more reactors. To effectively mitigate the sound, these shields must be substantially larger than the reactors and utilize sound absorbing material, e.g., acoustically insulating foam. Consequently, the cost of the shield could exceed the cost of the reactor it surrounds.

BRIEF DESCRIPTION OF THE DRAWINGS

The invention is explained in the following description in view of the drawings that show.

DETAILED DESCRIPTION OF THE INVENTION

Figure 1A:
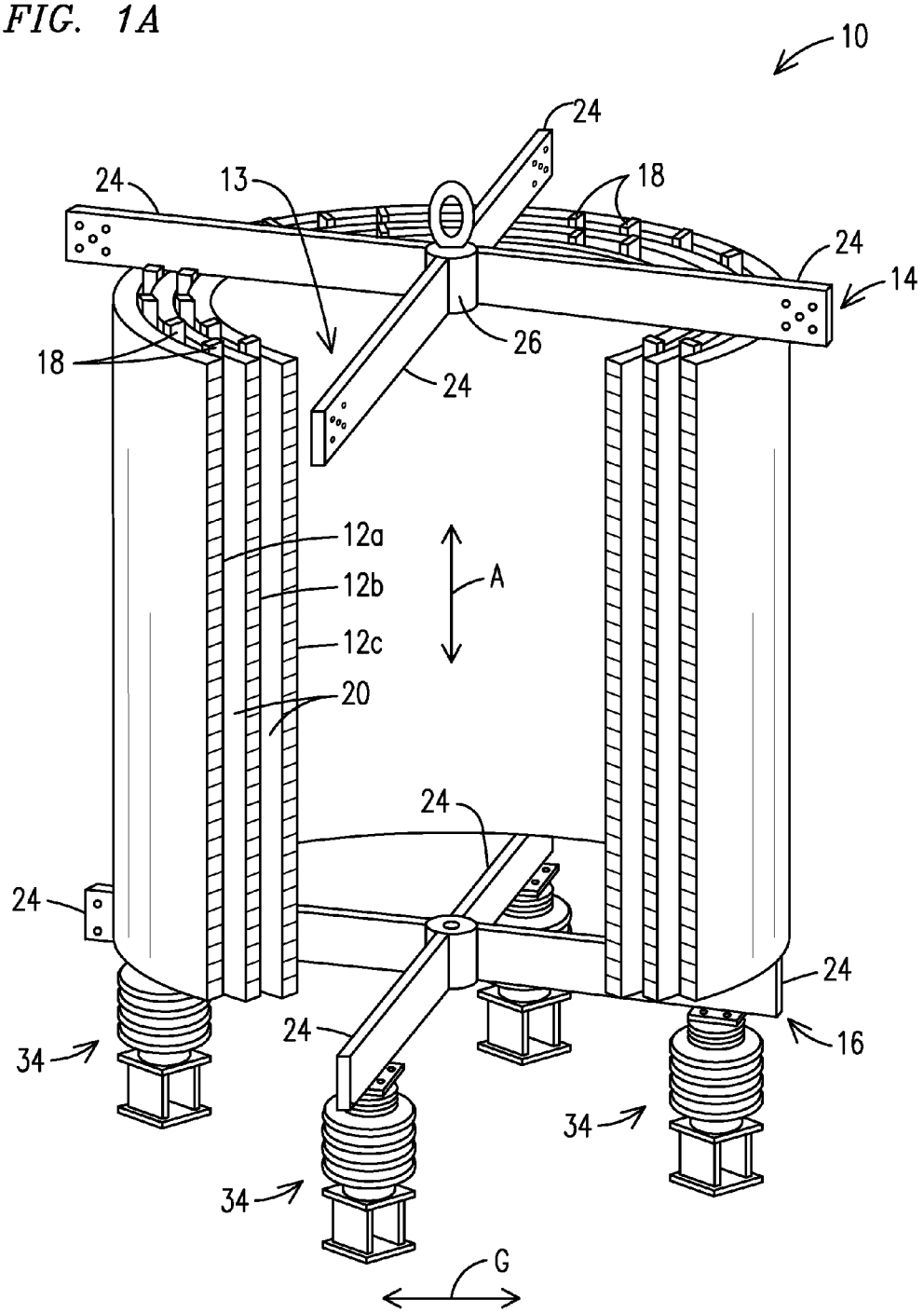
FIG. 1A is a partial perspective cut-away view of an air core, dry type reactor according to an embodiment of the invention, showing a series of winding layers positioned about an axis.

FIG. 1A is a partial cut-away perspective view of an air core, dry type reactor 10, according to one series of embodiments of the invention. The reactor is shown in a common orientation, positioned above a horizontal ground plane, G, with the central axis, A, extending vertically above the ground plane. As used herein, the term radial refers to a direction extending outward from or toward the axis, A. Radially outward refers to a direction away from the axis and radially inward refers to a direction toward the axis. Reference to a radial inner surface refers to a surface which faces the axis, A, and reference to a radial outer surface refers to a surface which faces away from the axis, A.

The reactor 10 comprises a series of cylindrically shaped, spaced-apart winding layers 12, concentrically positioned about the central axis. The partial view illustrates an outermost layer 12*a*, an intermediate layer 12*b* and an innermost layer 12*c*, but it is to be understood that intermediate layer 12*b* is representative of multiple such intermediate layers with the reactor comprising an arbitrary number of winding layers 12. Each such winding layer 12, also referred to herein as an active package, includes a reactive coil formed, for example, in a resin composite structure, to provide an electrical function related to transmission or delivery of electrical power. The winding layers 12 typically have a thickness range, as measured in the radial direction with respect to the axis, on the order of 0.5 to 5 cm.

The reactor 10 includes a hollow reactor cavity 13 extending radially inward from the inner-most winding layer 12*c* toward the axis, A. The cavity 13 and winding layers 12 are positioned between an upper spider unit 14 and a lower spider unit 16 with the layers 12 mechanically coupled to the spider units. The spider units have horizontal orientations with respect to the underlying ground plane, G.

The layers 12 of windings are each separated from one another by a series of spacers 18 positioned between each pair of adjacent winding layers. The spacers 18 are shown to have an exemplary vertical orientation, extending in a direction parallel to the central axis, A. The spacers 18 in each series are circumferentially spaced apart about each winding layer to provide spaces there between to collectively provide winding layer air gaps 20 between adjacent pairs of the layers 12.

The spider units 14, 16 each comprise a series of arms 24 extending along a plane and away from the axis, A, making contact with the winding layers 12. Although the illustrated upper and lower spider units 14, 16 are shown as having four such spider arms 24, the number of arms in the spider units may range from fewer than four to more than twelve. Among other functions, the spider arms of the units 14, 16 serve as line terminals (not illustrated) for effecting power connections to and between the winding layers 12, e.g., in an electrically parallel configuration. For a single reactor 10, and for at least a lower-most reactor 10 when arranged in a configuration of stacked reactors, the winding layers 12 are supported above the ground plane, G, by a combination of spider arms 24 of the lower unit 16 and a series of structural leg members 34.

Figure 1B:
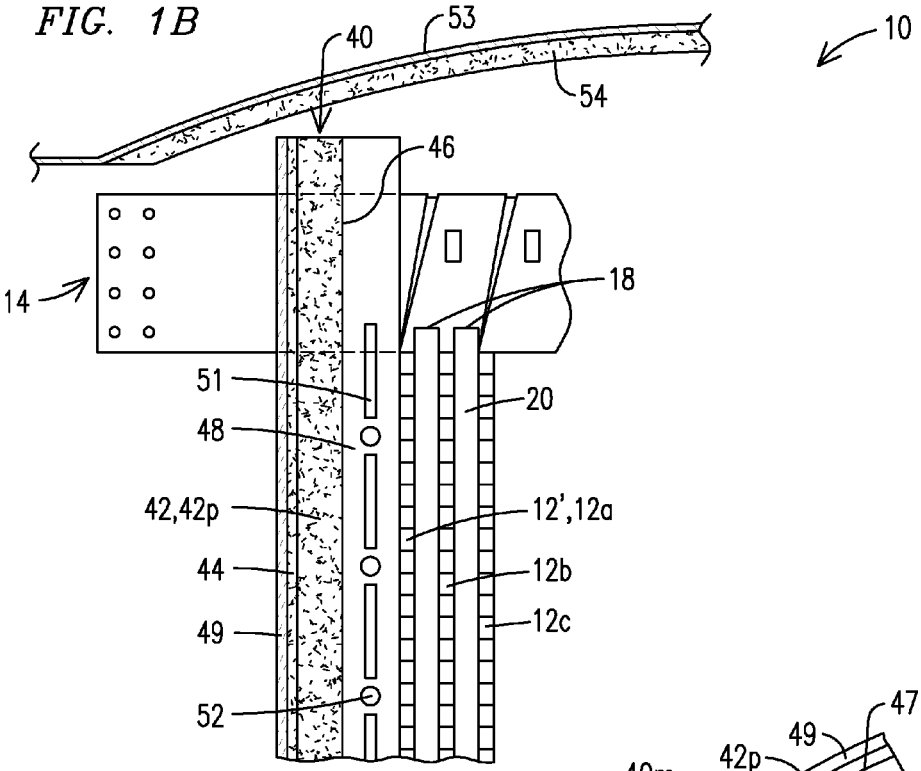
FIG. 1B is a partial sectional view of an air core reactor taken along a plane passing through a vertical central axis.

Referring to the partial sectional view of the reactor 10 shown in FIG. 1B, the reactor 10 also includes an outermost cylindrically shaped first layer 12' concentrically positioned about the layers 12. The layer 12' may be a winding layer 12, e.g., identical in function to one of the spaced-apart layers 12. However, the first layer 12', although similar in size, shape and concentric positioning as a winding layer 12, may be formed without a reactive coil, e.g., as a so-called dummy package layer, positioned to reduce the amount of noise transmitted out from the reactor 10. Such a dummy package layer 12' may be mechanically coupled to an adjacent winding layer 12 (e.g., layer 12*a*), positioned radially inward from the layer 12', to effectively form a larger mass which limits the magnitude of sound propagated from the outermost active package layer 12 to outside the reactor 10. That is, with the level of sound produced being proportional to the magnitude of movement of the outermost active package winding layer 12 (e.g., winding layer 12*a*), by coupling the mass of a dummy package layer 12' to the layer 12, radial excursions of the outermost active package are reduced, thereby reducing the levels of noise propagation.

The reactor 10 includes an integrated sound shield assembly 40, also in the form of a cylindrically shaped structure positioned radially outward from all of the layers 12 and positioned against the outermost first layer 12'. For the embodiment shown in FIG. 1B, the sound shield assembly 40 comprises three components: (i) a sound absorbing layer 42 extending circumferentially around the outermost first layer 12', (ii) a layer 44 of sound barrier material extending around the layer 42 of sound absorbing material, and (iii) a series of flexible members 48 extending circumferentially about the outermost first layer 12'. The flexible members 48 are positioned between the sound absorbing layer 42 and the outermost first layer 12'.

In the illustrated embodiments, the layers 42 and 44 and the flexible members 48 are assembled in a configuration where none of the afore-described components of the sound shield assembly 40 make direct contact with any of the spider unit support arms. By not making direct contact it is meant that neither of these layers and none of the flexible members physically contact the spider units. This arrangement limits transmission of acoustic signals into the sound shield.

As shown in FIG. 1B, the sound shield assembly 40 may extend above the upper spider unit 14 to absorb, block or reflect sound radiated from the layers 12 to an elevation at or above the spider unit 14. Further, a conventional cover 53 may be positioned over the reactor 10 to further limit emission of acoustic radiation. As indicated in FIG. 1B, an interior surface of the cover 53 may be lined with absorptive insulation material 54. To prevent mechanical coupling between portions of the assembly 40 proximate the upper spider unit 14, the layers 42 and 44 include cutouts (not shown) to maintain a spaced-apart relation between these acoustic components and the spider arms 24.

Figure 2B:
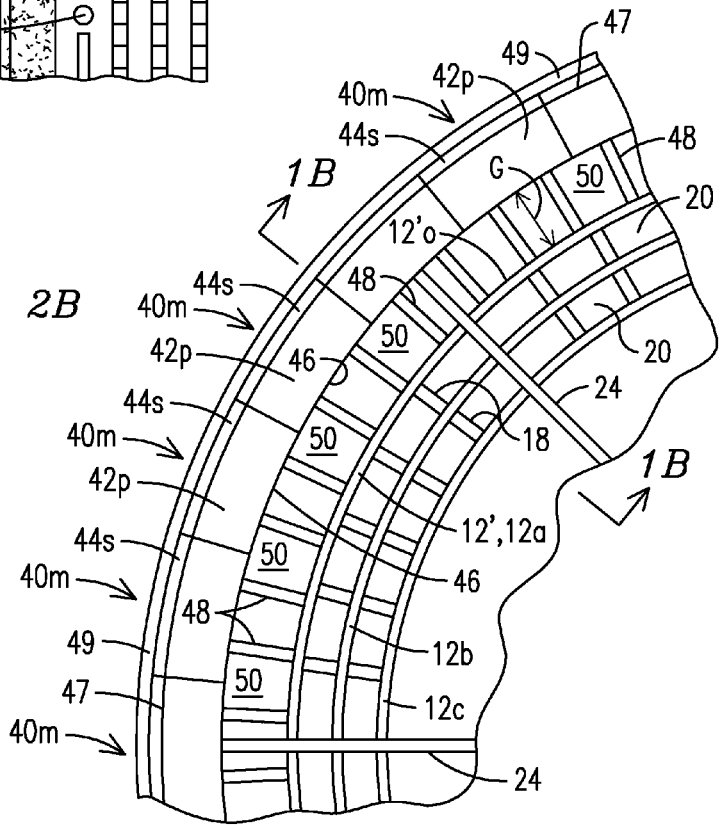
FIG. 2B is a partial plan view of an air core reactor shown further illustrating modular panels and other components in the sound shield assembly.
Figure 2A:
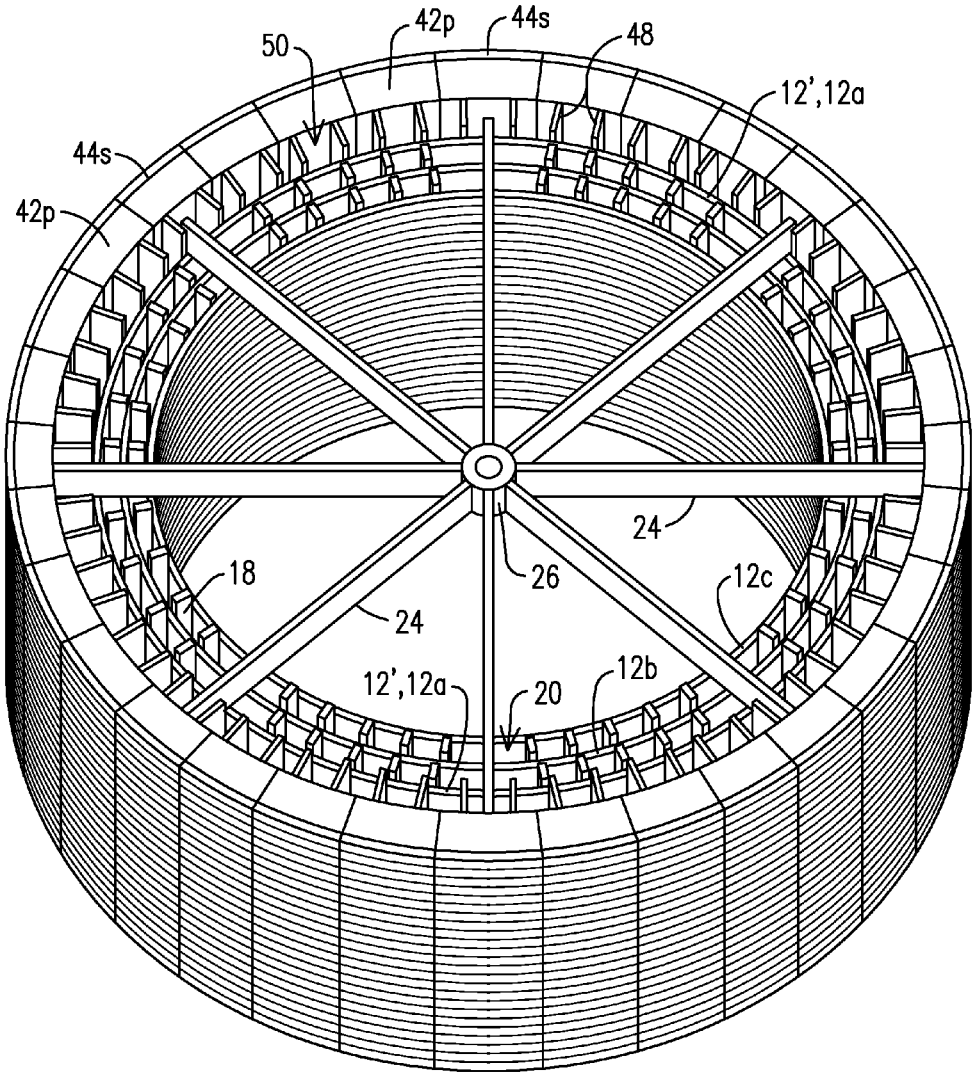
FIG. 2A is a perspective view of the an air core reactor illustrating features of an integrated sound shield assembly.

Installation of the sound mitigating shield assembly is facilitated by forming the entire assembly 40 as a series of modules 40*m*. See FIGS. 2A and 2B. The sound absorbing layer 42, which extends around the outermost first layer 12', comprises a plurality of sound absorbing panels 42*p* each having first and second opposing sides: radial inner side 46 and radial outer side 47. The panels 42*p* have a width, as measured along the circumference of the layer 42, ranging, for example, between about 15 and 45 cm. When assembled on the reactor 10, the first side 46 of each panel is a radially inner surface facing the axis A, while the second side 47 is a radially outer surface facing away from the axis, A. Each panel 42*p* comprises a sound absorbing material, such as a dense mineral wool in the form of a resilient panel. The panels 42*p* are configured for contiguous positioning along and against the outermost first layer 12', which layer may be a dummy package layer or an outermost active package winding layer 12. To facilitate such positioning, the panels may have sufficient flexibility to conform to the radius of curvature of a cylindrical contour positioned radially outward from the layer 12'.

With the layer 44 of sound barrier material formed as a series of discrete segments 44*s*, the modules 40*m* of the assembly 40 each comprise a segment 44*s* attached to the side 47 of a panel 42*p* and, optionally, a pair of spaced-apart flexible members 48. With each module 40*m* including a segment 44*s* of barrier material formed on the second side 47 of one of the panels 42*p*, when the panels 42*p* are assembled into the layer 42, the layer 44 is simultaneously provided as a cylindrical shape comprising a contiguous series of the segments 44*s*. Noting that the panels 42*p* may have a circumferential width on the order of 15-45 cm, a pair of the flexible members 48 may be affixed to the radially inner surface of the panel 42*p*, i.e., the side 46 facing the axis A, so that the resulting module 40*m* contains all components of a section of the assembly 40 for installation in one step. In other embodiments, the flexible members 48 may be affixed to the radial outer surface $\mathbf{12'}_o$ of the layer 12' with the module 40*m* positioned against the flexible members 48. In still other embodiments, the flexible members 48 may be wrapped in place and against the outer surface $\mathbf{12'}_o$ with a lapped curable resin composite comprising a fiberglass fabric. With one of these arrangements, each module is sequentially installed about the circumference which defines the cylindrical shape of the assembly 40. Initially, attachment of each module 40*m* may be effected by first positioning the module against the layer 12' and applying a coating of uncured resin to one or both contacting surfaces. For example, when the module 40*m* contains a pair of the flexible members 48, a surface of the member 48 coming into contact with the surface $\mathbf{12'}_o$ of the layer 12' is coated with curable resin, and surface regions of the panel inner side 46 are also coated with uncured resin prior to making contact with the flexible members 48.

After each module 40*m* is placed in position, roving of a curable fiberglass composite, i.e., in the form of a wet lay-up, is applied to wrap the modules, creating an outer cylindrical structure 49 which securely holds the entire layer 40 in place. The roving may be sequentially applied to adjoining panels 42*p* as each module 40*m* is installed. The process initially fastens each module in place to position the complete assembly 40 and then further lapping is provided to fully secure the structure in place. This cylindrical structure 49 of fiberglass roving 49, shown in FIG. 1B, can be cured in the same process which cures the layers 12.

The sound absorbing material of the layer 42 may be a composite material produced in sheet form to constitute the body of each of the panels 42*p* such that the panels can be individually lifted into place directly or indirectly against a section of the layer 12'. The positioned panels may, for example, be connected as a series of interlocking members. A suitable composite material for this application is a dense mineral wool fiber made from basalt rock or slag. An exemplary product of this type is a semi-rigid insulation board marketed under the names FabRock 60 and FabRock HT, having densities of 96 kg/m$^3$ and 105 kg/m$^3$, respectively, and manufactured by Roxul Inc. of Milton Ontario. In the illustrated embodiments the sound absorbing layer 42 may have a thickness, measured in the radial direction, of about 10 cm.

Numerous sound barrier materials are suitable for the barrier layer 44. These include K-Fonic GV manufactured in Youngsville, N.C., USA, as well as foam barrier composites manufactured in Holliston, Mass. USA, rigid plenum liners manufactured in Shelbyville, Ind. USA, and numerous urethane products.

With further reference to FIG. 1B, each of the flexible members 48 is an elongate, stick-like member which may be formed as a resin composite fiberglass structure. The flexible members 48 are each positioned between the radial outer surface $\mathbf{12}_o$ of the layer 12' and the radial inner side 46 of the sound absorbing layer 42, of a panel 42*p*. The flexible members 48 have an exemplary orientation parallel to the axis, A. This results in a thickness dimension, as measured in the radial direction, which provides a series of gaps 50 between the layer 12' and the radial inner surface of the sound absorbing layer 42. The flexible members 48 thus define a gap width, G, as measured along the radial direction.

With the gaps 50 adjoining the layer 42 of absorbing material, the volume which contains both the exemplary 10 cm thick sound absorbing layer 42 and the gaps 50 defines a resonant cavity which absorbs sound for a predefined wavelength. Further, the cavity formed by the combination of the layer 42 and the gaps 50 is tunable by adjusting the positions of the flexible members 48 relative to the radial inner side 46 of the sound absorbing layer 42. That is, the flexible members 48 may be recessed into the sound absorbing layer 42 thereby reducing the dimension, G, and shrinking the volume of the gaps 50. This, in turn, reduces the size of the resonant cavity formed by the combination of the sound absorbing layer 42 and the gaps 50. By way of example, for a ¼ wavelength of 14.2 cm, and with the sound absorbing layer 42 being 10 cm thick, the gap, G, can be adjusted to 4.2 cm to create a resonant cavity which matches the desired ¼ wavelength.

Summarily, an adjustable tuning cavity is provided wherein the width of each gap 50 can be the full radial thickness of the flexible members 48 or may be less than the thickness of the members 48 if the members 48 are recessed into the first sides 46 of the panels 42*p*. The resulting cavity size can thus be tuned to optimum resonant widths such as, for example, a quarter wavelength of a predominant acoustic emission to facilitate absorption of sound energy of a desired wavelength. By way of example, the cavity may have a width on the order of 0.1 to 1 cm.

The flexible members 48 are designed to reduce the transmission of vibration energy along paths between the layer 12' and the sound absorbing layer 42. According to the embodiment illustrated in FIG. 1B, the members 48 each comprise a series of slots 51 and circular shaped openings 52. The presence of these openings or gaps in the members limits the paths through the members by which energy can be transmitted between the layer 12' and the layer 42.

Embodiments have been described which provide effective noise mitigation in multiple frequency ranges. In the relatively high range, e.g., greater than 30 Hz, sound insulation materials incorporated in the panels 42*p* directly absorb acoustic radiation. In a lower frequency range, e.g., less than 8 kHz, the addition of mass to the active package layers and positioning of the resonant cavity next to the absorptive panels 42*p* effectively reduces the magnitude of acoustic radiation. Advantageously, use of mineral wool as the absorbent material provides fire resistance, retards combustion and generation of smoke, even during direct exposure to flames. The mineral wool has water repellant properties rendering the panels 42*p* useful in environments where moisture is anticipated. The sound shield assembly 40 is easily adaptable for incorporation into existing fabrication processes for air core reactors.

Designs incorporating sound shield assemblies 40 eliminate the requirement to build separate enclosures, e.g., as stand-alone units, to achieve specifications for acoustical performance. These designs also eliminate the use of large volumes of open cell acoustical insulation. Rather, the afore-described sound shield assembly permits integration of the acoustical noise mitigation treatment in the fabrication process of the reactor. Once the assembly 40 is installed, the entire reactor, including the assembly 40, can be placed in an oven to cure. The sound shield assembly 40 may be mechanically coupled to an active winding layer 12, 12' to add mass to the reactor and thereby limit movement of the coil in the layer. The assembly 40 may also include another shield (not shown) positioned radially outward from the assembly 40 in the form, for example, of a fiberglass panel or roved fiberglass cylinder which provides a dense barrier material to further attenuate acoustic radiation transmitted through the layers 42 and 44.

The individual components of the sound shield assembly 40 provide a more comprehensive and effective treatment of noise radiated from the layers 12 because the design permits mitigation in close proximity to the source, i.e., within the reactor itself. In addition, the design is suitable for retrofit applications for which the sound insulation assembly 40 may be provided in a kit comprising a plurality of the modules 40*m*. That is, the assembly 40 constitutes a durable, pre-insulated reactor shell which advantageously provides more cost effective mitigation relative to installation of a separate enclosure.

The afore-disclosed embodiments illustrate an assembly 40 which can be integrated with conventional fabrication processes for air core reactors. Other embodiments, which can also be integrated with air core reactor fabrication processes may incorporate additional layers 42 and 44 of absorptive and sound barrier material extending around the layer 12'. With multiple layers 42, 44, individual layers may be selected for optimum sound mitigation at preselected acoustic frequencies. Further, additional resonant cavities may be incorporated into the assembly 40 to further reduce the level of propagated sound.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The claimed invention is:

1. An air core dry type power reactor comprising:

upper and lower spider units each comprising a plurality of support arms extending radially outward from a central axis;

a plurality of cylindrically shaped layers concentrically positioned about one another and with respect to the central axis, some of the layers being winding layers arranged in spaced-apart relation from one another to provide gaps between some of the winding layers to allow air to flow along and between winding layers, the plurality of layers including an outermost first layer;

a sound shield positioned against the outermost first layer comprising (i) a layer of sound absorbing material extending around the outermost first layer, (ii) a layer of sound barrier material also extending around the outermost first layer, and (iii) a plurality of flexible members each positioned between the sound absorbing material and the outermost first layer.

2. The reactor of claim 1 wherein none of the layers of sound absorbing or sound barrier material and none of the flexible members make direct contact with any of the spider unit support arms, thereby limiting transmission of acoustic signals from the spider units into the sound shield and wherein the sound absorbing material is in the form of a plurality of panels extending about the outermost first layer and two or more of the positioned elongate members include a width dimension extending along a radial direction with respect to the axis to provide a separation distance between the sound absorbing material and the outermost first layer which separation distance defines a cavity.

3. The reactor of claim 2 wherein the separation distance between the sound absorbing material and the outermost first layer is up to the width dimension of the elongate members.

4. The reactor of claim 1 further including a fiberglass cylindrical structure wrapped about the sound shield to secure the sound shield against the outermost first layer.

5. The reactor of claim 4 wherein fiberglass cylindrical structure extends about both the layer of sound absorbing material and the layer of sound barrier material to support the sound shield above a ground plane primarily by pressing the sound shield against the outermost first layer.

6. The reactor of claim 1 wherein the flexible member is of an elongate shape having a length dimension substantially greater than a width dimension and fashioned to provide limited paths of transmission along the length dimension.

7. The reactor of claim 1 wherein the sound shield is supportively attached to the reactor without being supported by any of the spider unit support arms.

8. The reactor of claim 1 wherein the sound shield is supportively attached to the reactor with a wrap positioned radially outward from the outermost first layer, with the wrap circumferentially extending about the outermost first layer and pressing the sound shield against the outermost first layer so that the first layer supports the weight of the sound shield.

9. The reactor of claim 8 wherein the wrap comprises a cured resin material bonded to an outer surface of the sound shield.

10. The reactor of claim 1 wherein the outermost first layer is a winding layer.

11. The reactor of claim 1 wherein the outermost first layer comprises a dummy coil.

12. A noise mitigating sound shield in kit form for assembly and attachment to an air core dry type, power reactor of the type having a plurality of cylindrically shaped reactor coil layers positioned about an axis between (i) upper and lower spider unit support arms and (ii) an outermost first cylindrically shaped layer which may be a reactor coil layer or a dummy package layer, the kit comprising:

(i) a plurality of sound absorbing panels each having first and second opposing sides, each configured for positioning about a portion of the outermost first layer to collectively surround the outermost first layer so that with such positioning the plurality of panels reduce radiation of acoustic energy when the reactor coil layers carry current;

(ii) one or more flexible members attached along the first side of each sound absorbing panel for contact with the outermost first layer of the reactor; and (iii) a layer of sound barrier material positioned along the second side of each panel, wherein, when the flexible members are attached to a panel and the panel is installed about the outermost first layer of the reactor, the flexible members are positioned against the outermost first layer and the flexible members provide a gap between the first side of the panel and the outermost first layer of the reactor.

13. The noise mitigating sound shield of claim 12 wherein the gap provides a resonant cavity along a sound absorbing panel to reduce sound generated by one of the reactor coil layers.

14. The noise mitigating sound shield of claim 12 wherein, when the sound shield is installed against the outermost first layer of the reactor, none of the sound absorbing panels or flexible members make direct contact with any of the spider unit support arms, thereby limiting transmission of acoustic signals into the sound shield.

15. The noise mitigating sound shield of claim 12 wherein the panels are configured so that when the panels are positioned about the outermost first layer, the first panel sides face the reactor coil layers and conform to a contour consistent with assembly of the plurality of panels about the outermost first layer of the reactor.

16. The noise mitigating sound shield of claim 12 wherein, when installed on a reactor, further includes an attachment wrap positioned radially outward from the outermost first layer and which circumferentially extends about the outermost first layer to secure the sound shield against the outermost first layer.

17. The noise mitigating sound shield of claim 16 wherein, when installed on the reactor, the wrap is in the form of a fiberglass cylindrical structure extending about both the layer of sound absorbing material and the layer of sound barrier material to support the sound shield above a ground plane primarily by pressing the sound shield against the outermost first layer.

18. The noise mitigating sound shield of claim 17 wherein the sound shield is supportively attached to the reactor with the wrap positioned radially outward from the outermost first layer, with the wrap circumferentially extending about the outermost first layer and pressing the sound shield against the outermost first layer so that the first layer supports the weight of the sound shield.

19. The noise mitigating sound shield of claim 18 wherein the wrap comprises a cured resin material bonded to an outer surface of the sound shield.

20. The reactor of claim 1 wherein the sound shield assembly extends above the upper spider unit to absorb, block or reflect sound radiated from the winding layers to an elevation at or above the upper spider unit.

* * * * *